US007438591B2

(12) United States Patent
Chen et al.

(10) Patent No.: US 7,438,591 B2
(45) Date of Patent: Oct. 21, 2008

(54) CONNECTING MODULE

(75) Inventors: Chih-Tse Chen, Taoyuan Hsien (TW); Ching-Man Kao, Taoyuan Hsien (TW); Han-Cheng Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/352,350

(22) Filed: Feb. 13, 2006

(65) Prior Publication Data

US 2007/0105435 A1 May 10, 2007

(30) Foreign Application Priority Data

Nov. 4, 2005 (TW) ..... 094219042

(51) Int. Cl.
*H01R 13/60* (2006.01)

(52) U.S. Cl. ..... 439/540.1

(58) Field of Classification Search ..... 439/676, 439/540.1, 131, 535, 536, 76.1, 503, 344, 439/668, 677, 679, 638, 946; 361/737, 686, 361/785

See application file for complete search history.

(56) References Cited

U.S. PATENT DOCUMENTS

| | | | | |
|---|---|---|---|---|
| 6,417,812 | B1 * | 7/2002 | Tsai | 343/725 |
| 6,547,602 | B2 * | 4/2003 | Price et al. | 439/638 |
| 6,817,894 | B2 * | 11/2004 | Sanner et al. | 439/535 |
| 7,052,329 | B2 * | 5/2006 | Belopolsky et al. | 439/620.21 |
| 2001/0000161 | A1 * | 4/2001 | Laity | 439/676 |

* cited by examiner

*Primary Examiner*—Edwin A. León
(74) *Attorney, Agent, or Firm*—Birch Stewart Kolasch & Birch, LLP

(57) ABSTRACT

A connecting module includes a single housing including a front end, a first receiving hole and at least one second receiving hole. The first receiving hole is formed on the front end. The profile of the first receiving hole is used to receive a first external connecting plug. The second receiving hole is formed on the front end. The profile of the second receiving hole differs from that of the first receiving hole and is used to receive a second external connecting plug. The first and second receiving holes are arranged in a horizontal array.

20 Claims, 3 Drawing Sheets

CONNECTING MODULE

BACKGROUND OF THE INVENTION

1. Field of the Invention

The invention relates to a connecting module, ad in particular relates to a connecting module providing two receiving holes with different profiles and arranged in a horizontal array.

2. Description of the Related Art

With the rapid progress in information technology and the popularity of electronic devices, various computing systems, such as computers and the Internet, and related peripheral devices have been correspondingly developed, to facilitate the speed of retrieving data acquired from other places in the world.

Connectors, such as a RJ-45 connector, and a Universal Serial Bus (USB) are conventionally considered as the requirements for a computer to connect to the Internet and electronic devices, in particular, USB provides a better solution to easily connect several different electronic devices at the same time. In other devices such as X-Box or PS2, modem, Asymmetric Digital Subscriber Line (ADSL), Very High Data Rate Digital Subscriber Line (VDSL), or other Digital Subscriber Line (DSL), connectors and USB are also essential requirements for data transmission.

In FIG. 1, a RJ-45 connector 10 and a USB 20 are two individual elements disposed on a circuit board 30. The RJ-45 connector 10 and the USB 20, however, are spaced from each other at an undesired distance and needed to be installed on the circuit board 30 by different processes. Thus, time and cost cannot be decreased and volume of the electronic device cannot be reduced.

BRIEF SUMMARY OF THE INVENTION

A detailed description is given in the following embodiments with reference to the accompanying drawings.

The invention provides a connecting module for receiving a first external connecting plug and a second external connecting plug. The connecting module includes a first external connecting plug, a second external connecting plug, a single molded housing with a front end, and a first receiving hole and at least one second receiving hole, a first port disposed in the single molded housing and exposed by the first receiving hole to connect to the first external connecting plug, and at least one second port disposed in the single molded housing and exposed by the second receiving hole to connect to the second external connecting plug. The first and second receiving holes are formed on the front end. The profile of the first receiving hole is used to receive the first external connecting plug. The profile of the second receiving hole is different from that of the first receiving hole. The second receiving hole is used to receive the second external connecting plug. The first and second receiving holes are arranged in a horizontal array.

The first port is disposed in the single molded housing by embedding, engaging, bonding, welding, clicking, contacting, or integrally formed on the single molded housing. The first external connecting plug can be a RJ-11, RJ-12 or RJ-45 connector. The second port is disposed in the single molded housing by embedding, engaging, bonding, welding, clicking, contacting, or integrally formed with the single molded housing. The second external connecting plug can be a Universal Serial Bus (USB) plug with different structure or type.

In comparison with the related art, distance between the first and the second receiving holes of the invention can be narrowed, and the different receiving holes of the connecting module can be applied to a portable computer, X-Box or PS2, modem, Asymmetric Digital Subscriber Line (ADSL), Very High Data Rate Digital Subscriber Line (VDSL), or other Digital Subscriber Line (DSL) in a single step during the production process, to decrease required labor and time.

BRIEF DESCRIPTION OF THE DRAWINGS

The present invention will become more fully understood from the detailed description given here below and the accompanying drawings which are given by way of illustration only, and thus are not limitative of the present invention, and wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
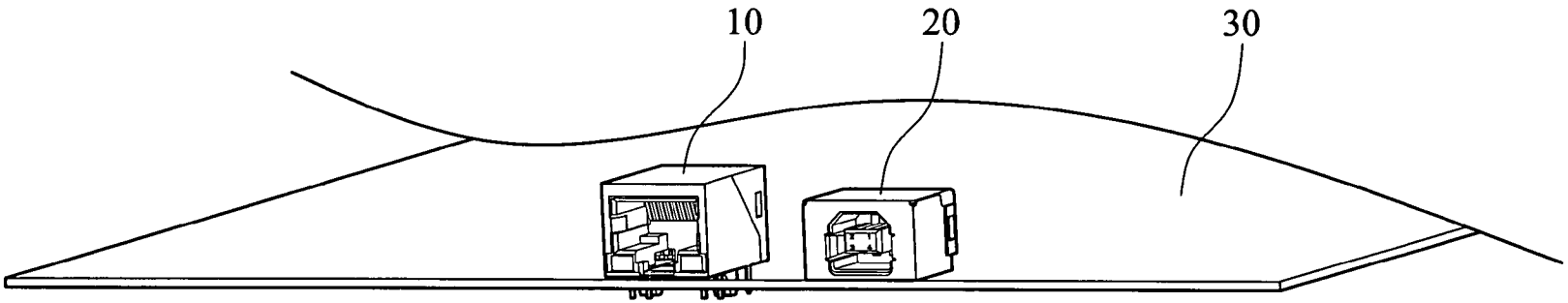
FIG. 1 ( RELATED ART )
FIG. 1 is a schematic view of a conventional connector (10) and a Universal Serial Bus (USB) connector (20)
Figure 2:
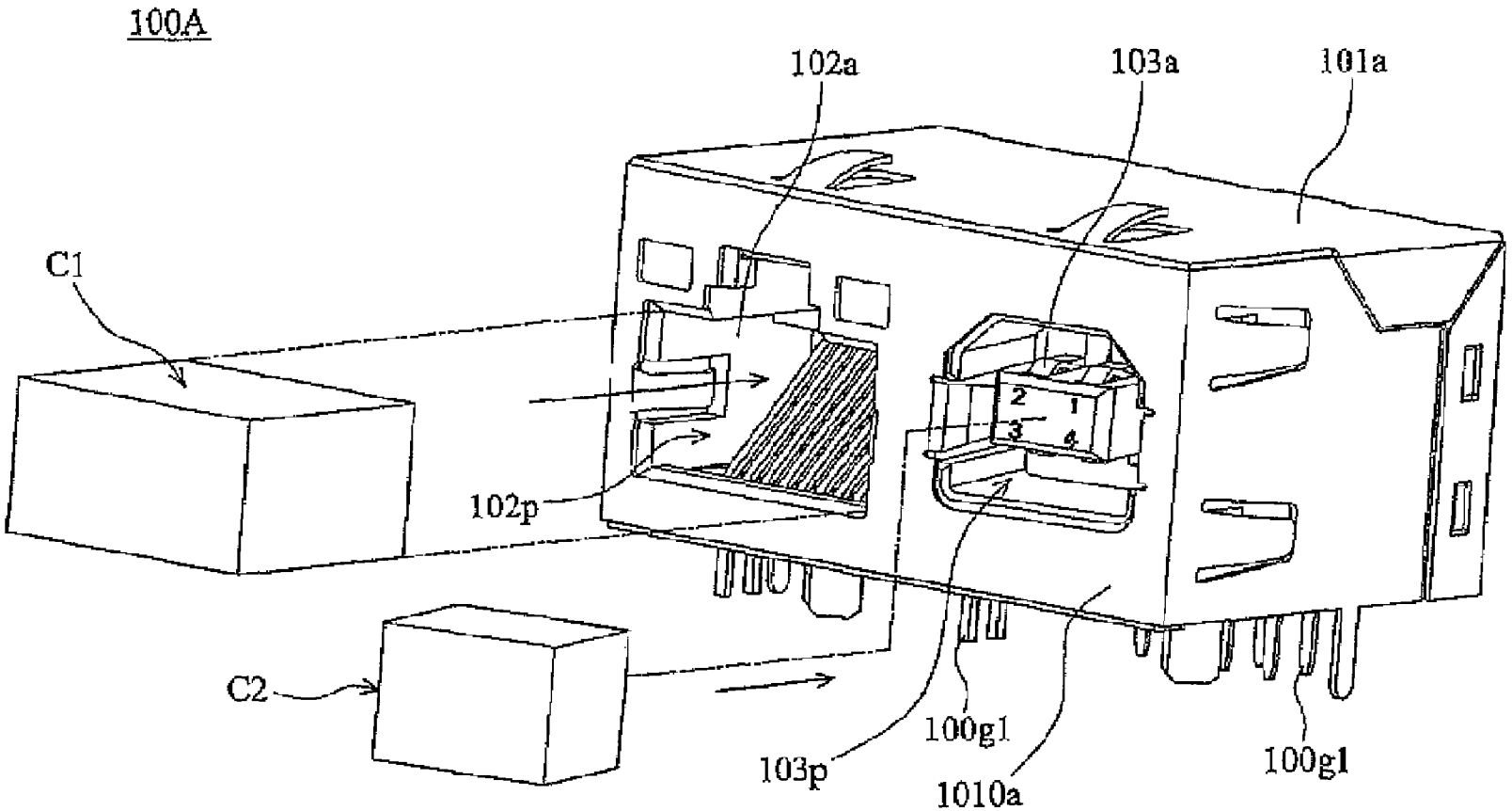
FIG. 2 is a schematic view of a connecting module (100A)

In FIG. 2, a connecting module 100A of the first embodiment includes a single molded housing 101*a*, a plurality of legs 100*g*1 disposed on the single molded housing 101*a* and utilized to connect to an external circuit board (not shown), a first port 102*p* is disposed in the single molded housing 101*a*, and a second port 103*p* is disposed in the single molded housing 101*a*. The single molded housing 101*a* includes a front end 1010*a*, a first receiving hole 102*a* formed on the front end 1010*a*, and a second receiving hole 103*a* formed on the front end 1010*a*. The profiles of the first and second receiving holes 120*a* and 103*a* are continuous and closed. The first port 102*p* is disposed in the single molded housing 101*a* and is exposed to outside by the first receiving hole 102*a*, and the second port 103*p* is disposed in the single molded housing 101*a* and is exposed to outside by the second receiving hole 103*a*. That is, the first port 102*p* and the second ports 103*p* are integrally formed in the single molded housing 101*a*. The profile of the first receiving hole 102*a* is used to receive a first external connecting plug C1 when the first external connecting plug C1 is connected to the first port 102*p*. The profile of the second receiving hole 103*a* is different from that of the first receiving hole 102*a*. The profile of the second receiving hole 103*a* is used to receive a second external connecting plug C2 when the second external connecting plug C2 is connected to the second port 103*p*. Thus, the received first and second external connecting plugs C1 and C2 are connected to the external circuit board via the legs 100*g*1.

The first port 102*p* is disposed in the single molded housing 101*a* by embedding, engaging, bonding, welding, clicking, contacting, or integrally formed on the single molded housing 101*a*. In this embodiment, the first port 102*p* is a RJ port and the second port 103*p* is a Universal Serial Bus (USB) port, the first external connecting plug C1 can be a RJ-11, RJ-12 or RJ-45 connector, and the second external connecting plug C2 is a Universal Serial Bus (USB) plug. The second receiving hole 103*a* is formed in the single molded housing 101*a* by embedding, engaging, bonding, welding, clicking, contacting, or integrally formed with the single molded housing 101*a*. The material of the single molded housing 101*a* is selected from plastic, metal, alloy, stainless or ceramic.

Figure 3:
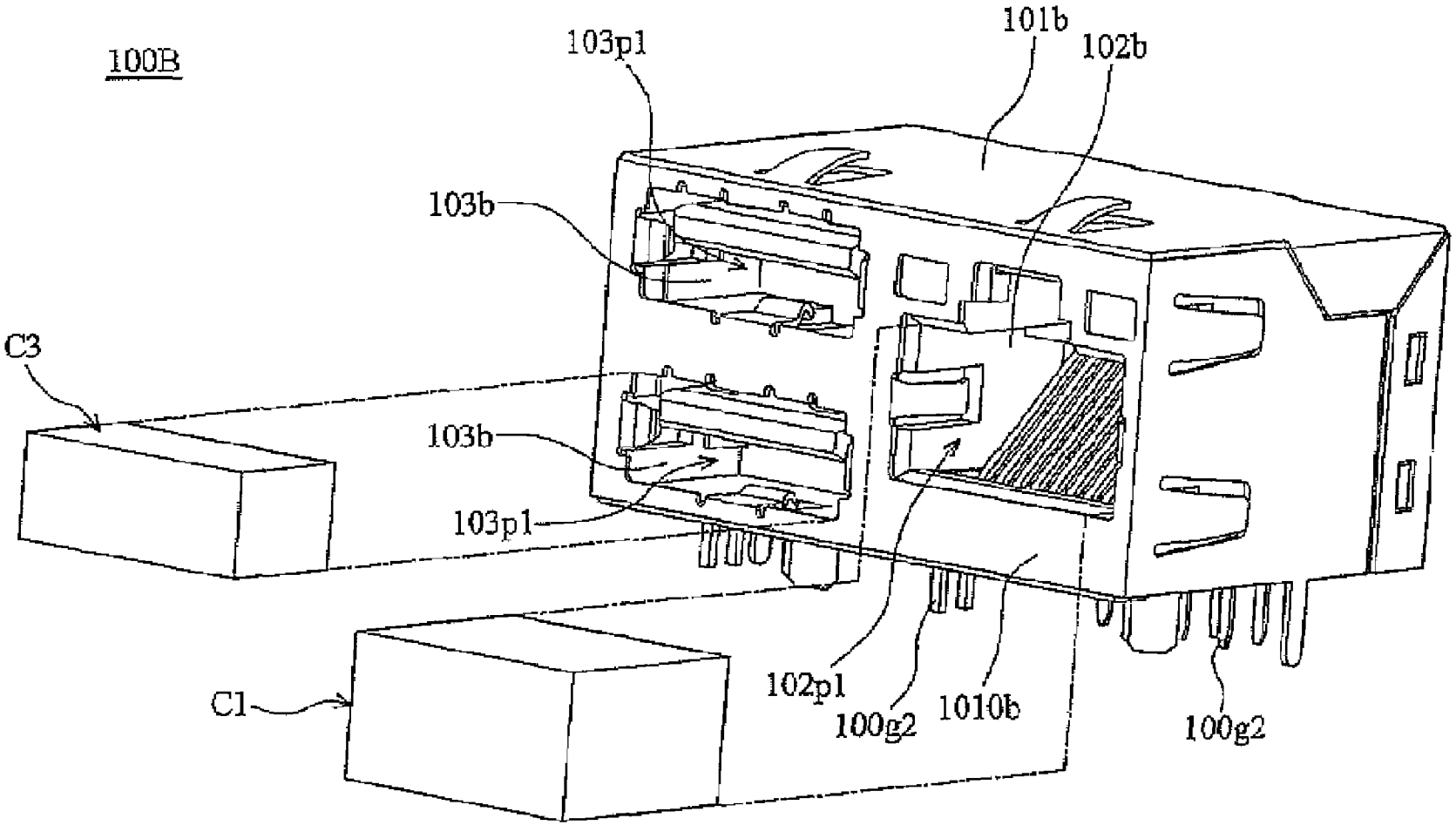
FIG. 3 is a schematic view of a connecting module (100B).

In FIG. 3, a connecting module 100B of the second embodiment is used for receiving a first external connecting plug C1 and a second external connecting plug C3 to an external circuit board (not shown). The connecting module 100B includes a single molded housing 101*b*, a plurality of legs 100*g*2 disposed on the single molded housing 101*b* to connect to the external circuit board, a first port 102*p*1 disposed in the single molded housing 101*b*, and two second ports 103*p*1 disposed in the single molded housing 101*b*. The single molded housing 101*b* includes a front end 1010*b*, a first receiving hole 102*b* formed on the front end 1010*b* for receiving the first external connecting plug C1, and two second receiving holes 103*b* formed on the front end 1010*b* for receiving the second external connecting plug C3. The profiles of the first and second receiving holes 120*b* and 103*b* are continuous and closed.

The first port 102*p*1 is disposed in the single molded housing 101*b* and is exposed to outside by the first receiving hole 102*b*, and the second ports 103*p*1 are disposed in the single molded housing 101*b* and are exposed to outside by the second receiving holes 103*b*. That is, the first port 102*p*1 and the second ports 103*p*1 are integrally formed in the single molded housing 101*b*. The first receiving hole 102*b* of the connecting module 100B has the same structure as the first receiving hole 102*a* of the connecting module 100A of the first embodiment. In this embodiment, the first port 102*p*1 is a RJ port and the second ports 103*p*1 are Universal Serial Bus (USB) ports. The profile of the first receiving hole 102*b* is different from that of the second receiving hole 103*b*, and the first and second receiving holes 102*b* and 103*b* are arranged in a horizontal array. The adjacent second receiving holes 103*b* are arranged in a perpendicular array. The material of the single molded housing 101*b* is selected from plastic, metal, alloy, stainless or ceramic. When a RJ plug and a USB plug are received by the first port 102*p*1 and the second ports 103*p*1, respectively, the received RJ plug and the USB plug are thus connected to the external circuit board via the legs 100*g*2.

In comparison with the related art, the distance between the first and the second receiving holes of the invention can be narrowed, and the different receiving holes of the connecting module can be applied to a portable computer, X-Box or PS2, modem, Asymmetric Digital Subscriber Line (ADSL), Very High Data Rate Digital Subscriber Line (VDSL), or other Digital Subscriber Line (DSL) in a single step during the production process, to decrease required labor and time. Particularly, the connecting module of the invention is suitable for small-size and thin electronic devices, as it can help to decrease volume and weight of the electronic device.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A connecting module for connecting a first external connecting plug and a second external connecting plug to an external circuit boards, comprising:

a single molded housing having a front end, a first receiving hole formed on the front end and having a profile corresponding to the first external connecting plug, and at least one second receiving hole formed on the front end to receive the second external connecting plug;

a plurality of legs disposed on the single molded housing to be connected to the external circuit board;

a first port disposed in the single molded housing and exposed by the first receiving hole to connect to the first external connecting plug so that the first external connecting plug can be connected to the external circuit boards via the legs; and at least one second port disposed in the single molded housing and exposed by the at least one second receiving hole to connect to the second external connecting plug so that the second external connecting plug can be connected to the external circuit board via the legs, wherein a profile of the at least one second receiving hole differs from that of the first receiving holes, and the first receiving hole and the at least one second receiving hole are arranged in a horizontal array, wherein the first port and the at least one second port are integrally formed in the single molded housing.

2. The connecting module as claimed in claim 1, wherein the first port is formed on the single molded housing by embedding, engaging, bonding, welding, clicking or contacting.

3. The connecting module as claimed in claim 1, wherein the at least one second port is formed on the single molded housing by embedding, engaging, bonding, welding, clicking and contacting.

4. The connecting module as claimed in claim 1, wherein the amount of the at least one second receiving hole is two, and the second receiving holes are adjacent to each other and arranged in a perpendicular array.

5. The connecting module as claimed in claim 1, wherein the material of the single molded housing is selected from plastic, metal, alloy, stainless or ceramic.

6. The connecting module as claimed in claim 1, wherein the connecting module is applied to a portable computer, X-Box or PS2, a modem, Asymmetric Digital Subscriber Line, Very High Data Rate Digital Subscriber Line, or other Digital Subscriber Lines.

7. A connecting module for connecting an RJ plug and a Universal Serial Bus plug to an external circuit board, comprising:

a single molded housing comprising a front end, a first receiving hole formed on the front end to receive the RJ plug, and at least one second receiving hole formed on the front end to receive the Universal Serial Bus plug;

a plurality of legs disposed on the single molded housing to connect to the external circuit board;

a first port disposed in the single molded housing and exposed by the first receiving hole to connect to the RJ plug so that the RJ plug can be connected to the external circuit board via the legs; and at least one second port disposed in the single molded housing and exposed by the at least one second receiving hole to connect to the Universal Serial Bus plug so that the Universal Serial Bus plug can be connected to the external circuit board via the legs, wherein the first receiving hole and the at least one second receiving hole are arranged in a horizontal array, wherein the first port and the at least one second port are integrally formed in the single molded housing.

8. The connecting module as claimed in claim 7, wherein the first port is formed on the single molded housing by embedding, engaging, bonding, welding, clicking or contacting.

9. The connecting module as claimed in claim 7, wherein the at least one second port is formed on the housing by embedding, engaging, bonding, welding, clicking or contacting.

10. The connecting module as claimed in claim 7, wherein the amount of the at least one second receiving hole is two, and the second receiving holes are adjacent to each other and arranged in a perpendicular array.

11. The connecting module as claimed in claim 7, wherein the material of the single molded housing is selected from plastic, metal, alloy, stainless or ceramic.

12. The connecting module as claimed in claim 7, wherein the connecting module is applied to a portable computer, X-Box or PS2, modem, Asymmetric Digital Subscriber Line, Very High Data Rate Digital Subscriber Line, or other Digital Subscriber Lines.

13. A connecting module for connecting a first external connecting plug and a second external connecting plug, comprising:

a single molded housing comprising a first receiving hole having a profile corresponding to the first external connecting plug and at least one second receiving hole to receive the second external connecting plug;

a first port disposed in the single molded housing and exposed by the first receiving hole to connect to the first external connecting plug; and at least one second port disposed in the single molded housing and exposed by the at least one second receiving hole to connect to the second external connecting plug, wherein a profile of the first receiving hole is different from that of the at least one second receiving hole, wherein the first port and the at least one second port are integrally formed in the single molded housing, wherein the profiles of the first receiving hole and the at least one second receiving hole are continuous and closed.

14. The connecting module as claimed in claim 13, wherein the first port is an RJ port.

15. The connecting module as claimed in claim 13, wherein the at least one second port is a Universal Serial Bus port.

16. The connecting module as claimed in claim 13, wherein the amount of the at least one second receiving hole is two, and the at least one second receiving holes are adjacent to each other and arranged in a perpendicular array.

17. The connecting module as claimed in claim 13, wherein the first port is formed on the single molded housing by embedding, engaging, bonding, welding, clicking, contacting, or integrally formed with the single molded housing.

18. The connecting module as claimed in claim 13, wherein the at least one second port is formed on the single molded housing by embedding, engaging, bonding, welding, clicking, contacting, or integrally formed with the single molded housing.

19. The connecting module as claimed in claim 13, wherein the material of the single molded housing is selected from plastic, metal, alloy, stainless or ceramic.

20. The connecting module as claimed in claim 13, wherein the connecting module is applied to a portable computer, X-Box or PS2, modem, Asymmetric Digital Subscriber Line, Very High Data Rate Digital Subscriber Line, or other Digital Subscriber Lines.

* * * * *